US007661287B1

(12) United States Patent
Arendt et al.

(10) Patent No.: US 7,661,287 B1
(45) Date of Patent: Feb. 16, 2010

(54) AUTO BODY DECRIMPING TOOL ASSEMBLY

(76) Inventors: Thomas Arendt, 18975 Incline Rd., Norwalk, WI (US) 54648; Tod O. Rousseau, 318 S. Court St., Sparta, WI (US) 54656

( * ) Notice: Subject to any disclaimer, the term of this patent is extended or adjusted under 35 U.S.C. 154(b) by 412 days.

(21) Appl. No.: 11/648,504

(22) Filed: Jan. 3, 2007

Related U.S. Application Data

(60) Provisional application No. 60/854,732, filed on Oct. 27, 2006.

(51) Int. Cl.
*B21D 5/16* (2006.01)
*B21J 13/08* (2006.01)
*B21C 1/00* (2006.01)

(52) U.S. Cl. ..... 72/457; 72/705

(58) Field of Classification Search ..... 72/457–458, 72/479, 384, 387, 705; 29/243.5
See application file for complete search history.

(56) References Cited

U.S. PATENT DOCUMENTS

| | | | | |
|---|---|---|---|---|
| 4,926,536 | A | 5/1990 | Kohut | |
| 5,052,209 | A | 10/1991 | DeMaagd | |
| 6,038,753 | A | 3/2000 | Willett | |
| 6,311,378 | B1 * | 11/2001 | Menguc | 29/235 |
| 6,439,024 | B1 | 8/2002 | Staquet | |
| 6,470,729 | B1 | 10/2002 | Hughes et al. | |
| 6,578,404 | B1 | 6/2003 | Rousseau | |
| 6,609,406 | B1 | 8/2003 | Staquet | |
| 6,772,495 | B1 | 8/2004 | Gerhards | |
| 6,898,958 | B2 | 5/2005 | Staquet | |
| 7,017,385 | B2 | 3/2006 | Trueit et al. | |
| 7,107,660 | B2 | 9/2006 | Staquet | |

* cited by examiner

*Primary Examiner*—Dana Ross
*Assistant Examiner*—Mohammad Yusuf
(74) *Attorney, Agent, or Firm*—Tipton L. Randall

(57) ABSTRACT

An auto body decrimping tool assembly for decrimping a panel from a vehicle frame. The decrimping tool assembly includes a hollow housing body member with a first aperture at one end and a second aperture. A decrimping head member is pivotally mounted near an end thereof on a drive shaft member rotatably secured in the body member's second aperture. The decrimping head member includes a base portion having a protruding contact section and an opposed, protruding blade section having a concave, helical surface facing the contact section. The blade section includes a tapered edge at a side of the concave, helical surface opposite the base portion. The decrimping head member is mounted to the drive shaft member at the contact section.

The decrimping head member is positioned at an edge of a panel crimped to the frame with the contact section on an edge of the crimped panel and the tapered edge of the blade section between the crimped panel and the frame. A power source, positioned at the body member's first aperture and operably connected to the drive shaft member, imparts reciprocal rotary motion to the drive shaft. The drive shaft causes the blade section and tapered edge of the decrimping head member to reciprocally pivot relative to the contact section, thereby incrementally decrimping the panel from the frame as the crimped panel and frame move between the blade section and the contact section of the decrimping head member.

10 Claims, 6 Drawing Sheets

AUTO BODY DECRIMPING TOOL ASSEMBLY

CROSS-REFERENCE TO RELATED APPLICATIONS, IF ANY

This application claims the benefit under 35 U.S.C. §119 (e) of co-pending provisional application Ser. No. 60/854,732, filed 27 Oct., 2006. Application Ser. No. 60/854,732 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

This invention relates to decrimping tools and, more particularly, to a powered decrimping tool for unfolding the flange of an automobile door skin panel from an existing door shell, as well as for decrimping other irregularly shaped parts.

2. Background Information

Auto body repair often involves replacement of a panel or "skin" from a portion of the vehicle. For example, a vehicle door has a frame with an inner, upholstered panel and an outer, metal panel that is painted. Damage to the door outer panel can be repaired without replacement of the whole door. The door outer panel is fastened to the door frame by crimping the edge of the outer panel over the edge of the door frame and by an adhesive applied before crimping. Once the outer panel is removed, a new replacement panel is secured to the door frame by applying an adhesive and crimping the replacement panel edge around the door frame.

One of the applicants has invented an auto body crimping tool designed to quickly crimp a replacement panel to a vehicle door frame or similar vehicle body location. The crimping tool is described in U.S. Pat. No. 6,578,404, issued Jun. 17, 2003, and is hereby incorporated by reference.

Removal of an auto body panel is no small task and care must be taken not to damage the supporting frame or mar the finish of adjacent, undamaged panels. Some tools for removing auto body panels have been granted patents. These include U.S. Pat. No. 4,926,536 by Kohut; U.S. Pat. No. 5,052,209 by DeMaagd; U.S. Pat. No. 6,038,753 by Willett; U.S. Pat. No. 6,439,024 by Staquet; U.S. Pat. No. 6,470,729 by Hughes et al.; U.S. Pat. No. 6,609,406 by Staquet; U.S. Pat. No. 6,772,495 by Gerhards; U.S. Pat. No. 6,898,958 by Staquet; U.S. Pat. No. 7,017,385 by Trueit et al.; and U.S. Pat. No. 7,107,660 by Staquet. However, there exists an unmet need for a tool that can quickly and easily remove an auto body panel without damaging the auto body frame or adjacent exterior or interior panels. Applicants have devised an auto body decrimping tool that fulfills this unmet need.

SUMMARY OF THE INVENTION

The invention is directed to an auto body decrimping tool assembly adapted for decrimping a panel from a frame. The tool assembly comprises a hollow housing body member with a first aperture centered on a body member's first axis at one end thereof. The body member contains a second aperture centered on a body member's second axis perpendicular to the first axis. A decrimping head member is pivotally mounted near an end thereof on a drive shaft member, rotatably secured in the body member's second aperture. The decrimping head member includes a base portion having first and second sides. The base member's first side is opposite the housing body member and has a protruding contact section and an opposed, protruding blade section which has a concave, helical surface facing the contact section. The blade section includes a tapered edge at the side of the concave, helical surface opposite the base portion. The decrimping head member is mounted to the drive shaft member at the contact section.

The decrimping head member is positioned at an edge of a panel crimped to the frame with the contact section on an edge of the crimped panel and the tapered edge of the blade section between the crimped panel and the frame. A power source, positioned at the body member's first aperture and operably connected to the drive shaft member, imparts reciprocal rotary motion to the drive shaft. The drive shaft causes the blade section and tapered edge of the decrimping head member to reciprocally pivot relative to the contact section, thereby incrementally decrimping the crimped panel from the frame as the crimped panel and frame move between the blade section and the contact section of the decrimping head member.

In a further embodiment of the invention, the device includes a power source positioned and secured at the first aperture of the housing body member. The power source is operably connected to the drive shaft member and imparts reciprocal rotary motion to the drive shaft, causing the blade section and tapered edge of the decrimping head member to reciprocally pivot relative to the contact section, thereby incrementally decrimping the crimped panel from the frame as the crimped panel and frame move between the blade section and the contact section of the decrimping head member.

DESCRIPTION OF THE EMBODIMENTS

Nomenclature

10 Decrimping Tool Assembly
20 Hollow Housing Body Member
25 First Aperture in Body Member
30 Second Aperture in Body Member
35 Drive Shaft Member of Decrimping Tool Assembly
40 Decrimping Head Member
45 Base Portion of Decrimping Head Member
47 First Side of Base Portion
48 Second Side of Base Portion
50 Contact Section of Decrimping Head Member
52 Threaded Fastener of Decrimping Head Member
54 Aperture in Decrimping Head Member
55 Shoulder Area of Cylindrical Base Member
57 Cylindrical Base Member of Contact Section
60 Blade Section of Decrimping Head Member
65 Concave, Helical Surface of Blade Section
70 Tapered Edge of Blade Section
75 Multipoint Indentation in Second Side of Base Portion
80 Insert Member
85 Head Portion of Insert Member
90 Cylindrical Body Portion of Insert Member
95 Central Aperture of Insert Member
100 Decrimping Tool and Power Source Assembly
110 Pneumatic Power Source
115 Compressed Air Supply Inlet

Construction

Figure 1:
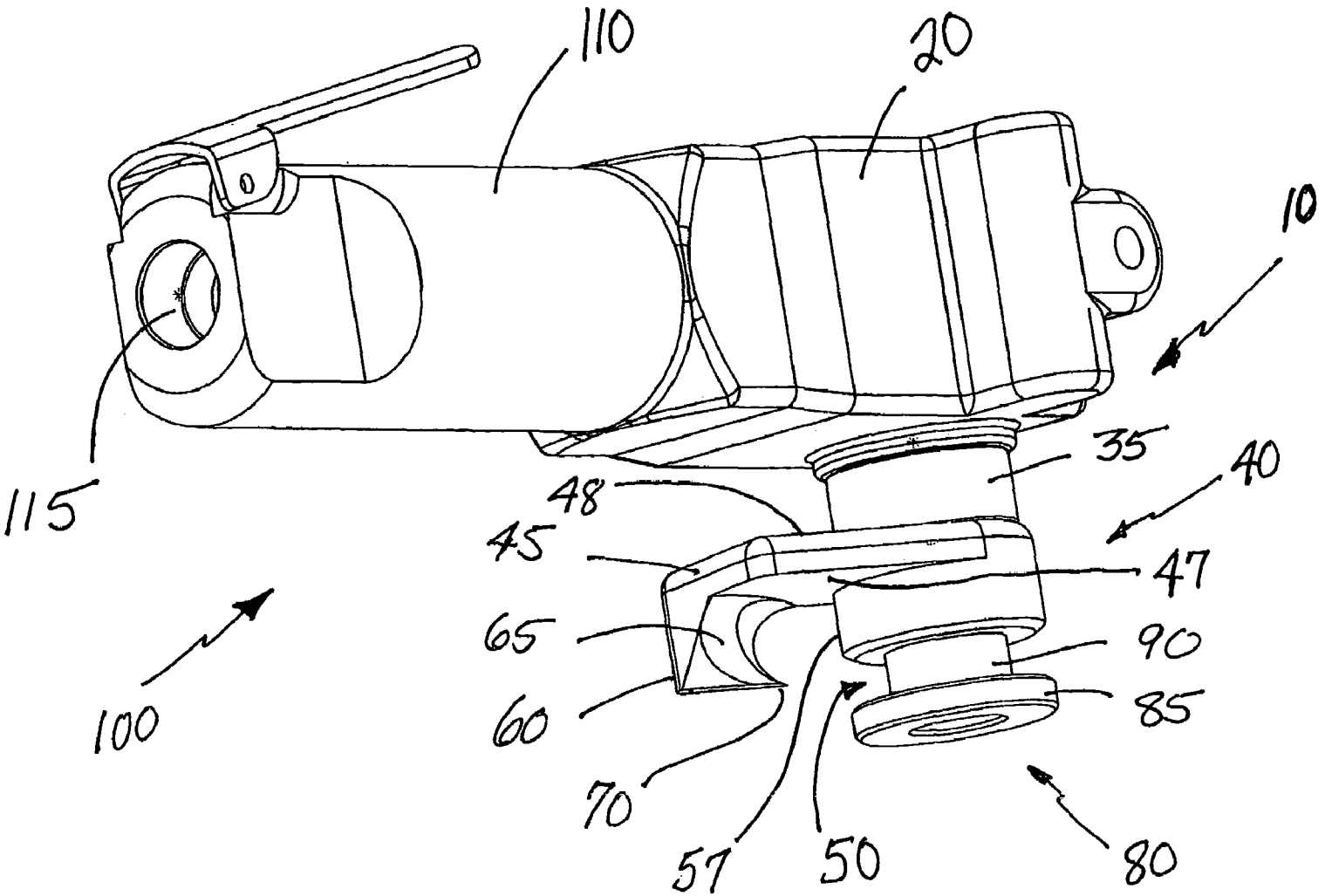
FIG. 1 is a perspective view of the auto body decrimping tool assembly of the present invention.
Figure 2:
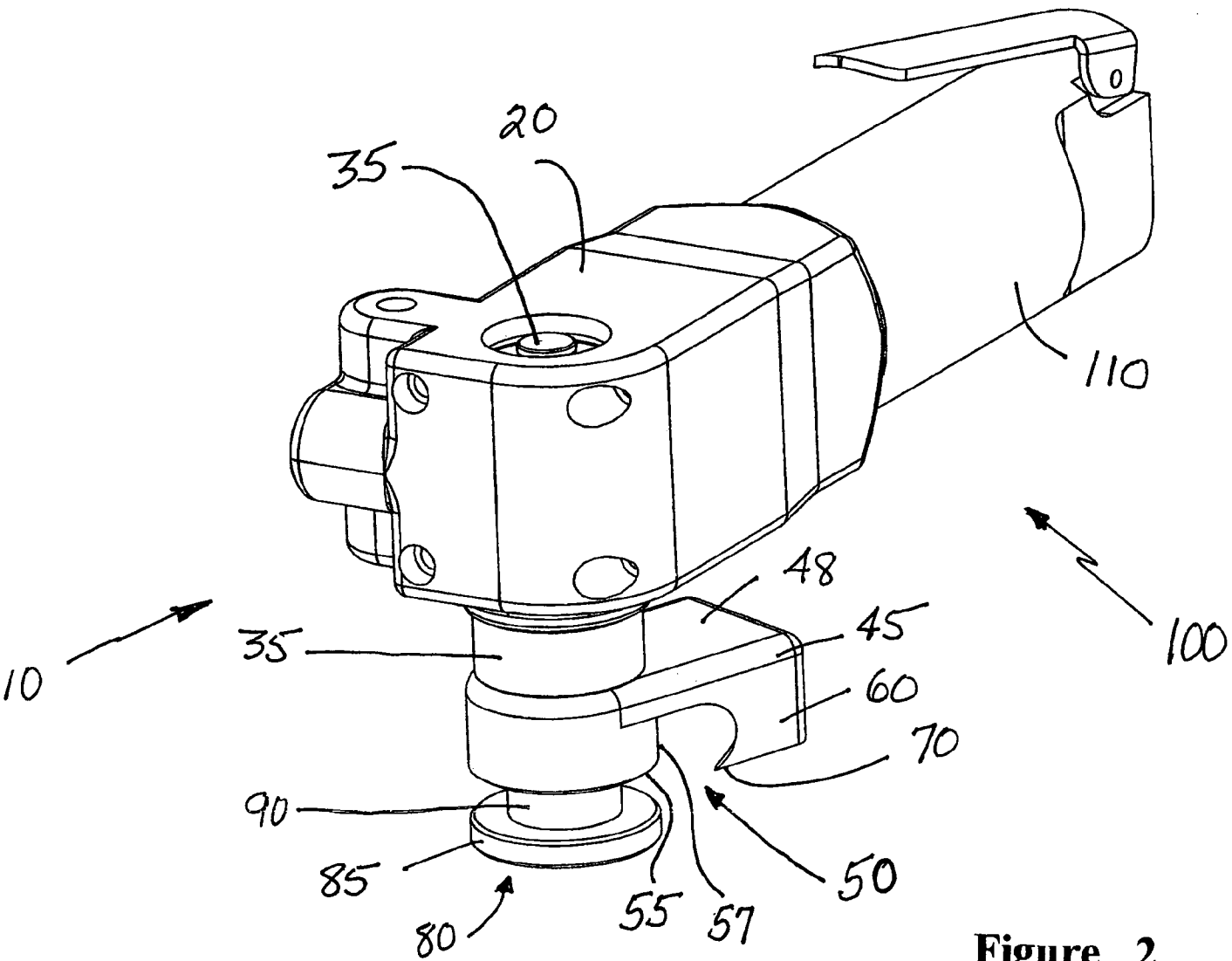
FIG. 2 is another perspective view of the auto body decrimping tool assembly of the present invention.
Figure 3:
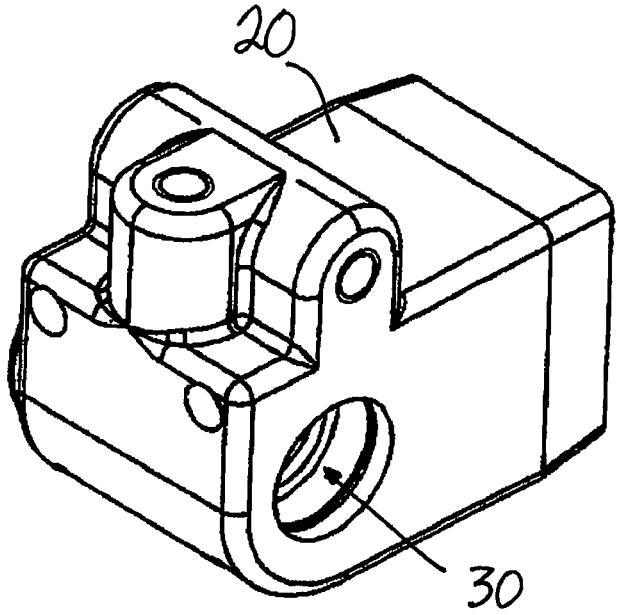
FIG. 3 is a perspective view of the hollow housing body member of the auto body decrimping tool assembly of the present invention.
Figure 4:
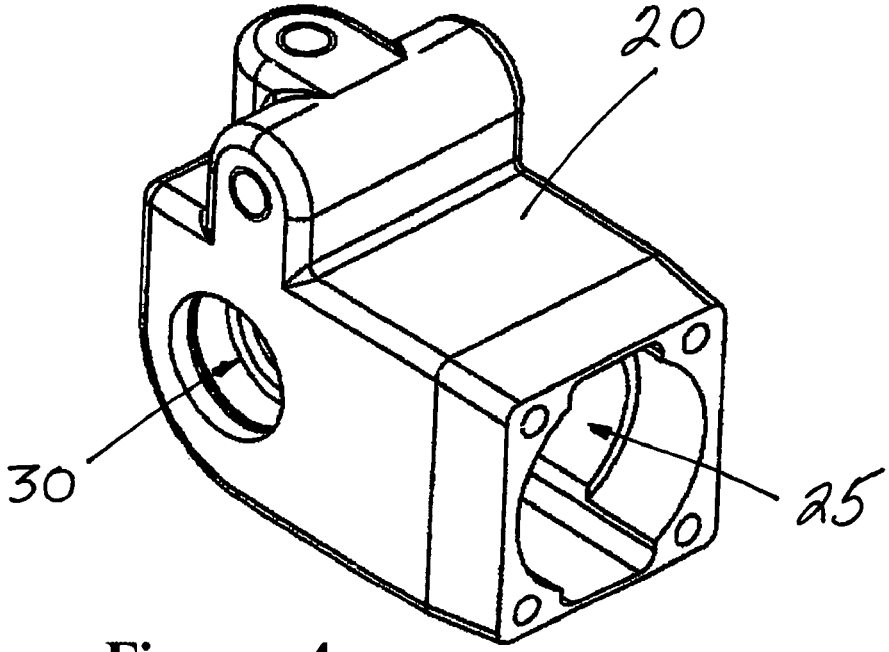
FIG. 4 is another perspective view of the hollow housing body member of the auto body decrimping tool assembly of the present invention.

Referring to FIGS. 1 and 2, one embodiment of the auto body decrimping tool and power source assembly 100 is shown. The decrimping tool and power source assembly 100 includes a decrimping tool assembly 10, having a hollow housing body member 20 with a first aperture 25 centered on a body member's first axis at one end thereof, as seen in FIG. 3. The hollow body member 20 also contains a second aperture 30 centered on a body member's second axis perpendicular to the first axis, as seen in FIGS. 3 and 4. A drive shaft member 35, secured by a bearing (not shown) in the second aperture 30, supports and powers a decrimping head member 40, having a contact section 50 and a blade section 60 there upon.

Figure 5:
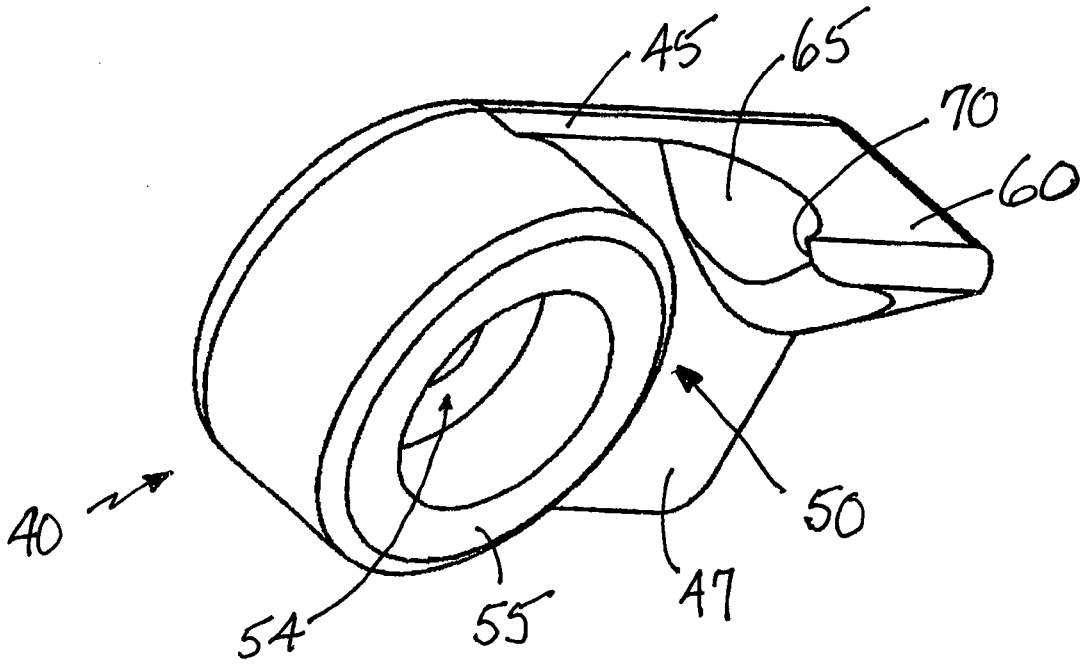
FIG. 5 is a perspective side view of the decrimping head member of the auto body decrimping tool assembly of the present invention.
Figure 6:
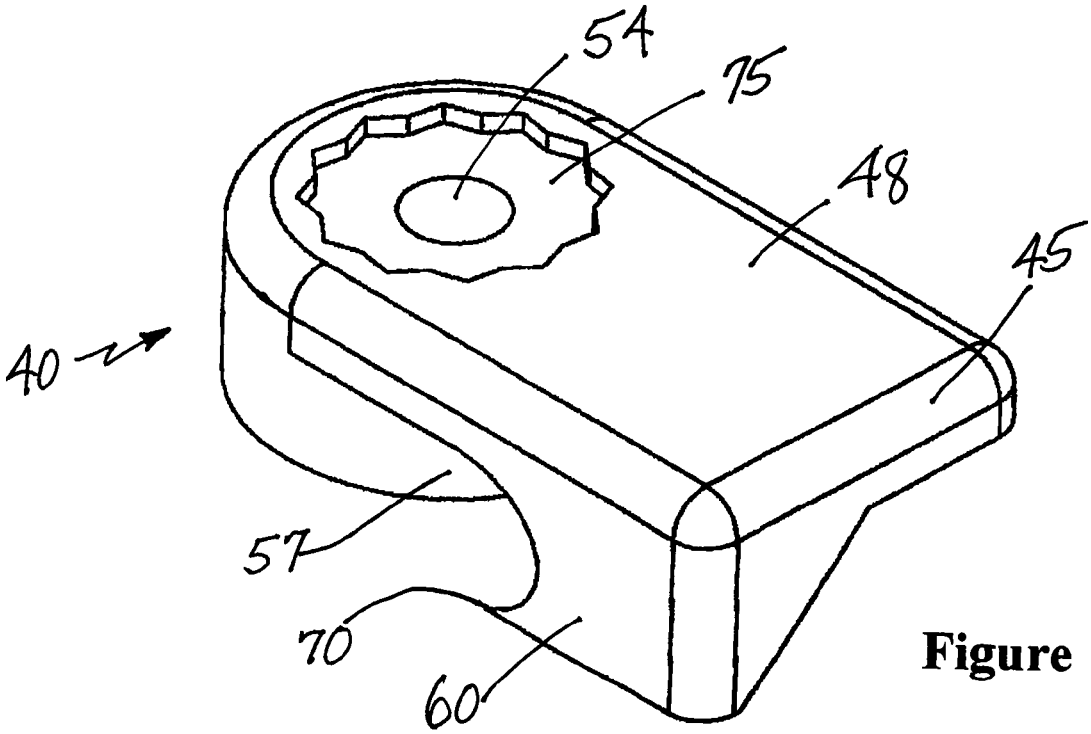
FIG. 6 is a perspective bottom view of the decrimping head member of the auto body decrimping tool assembly of the present invention.
Figure 7:
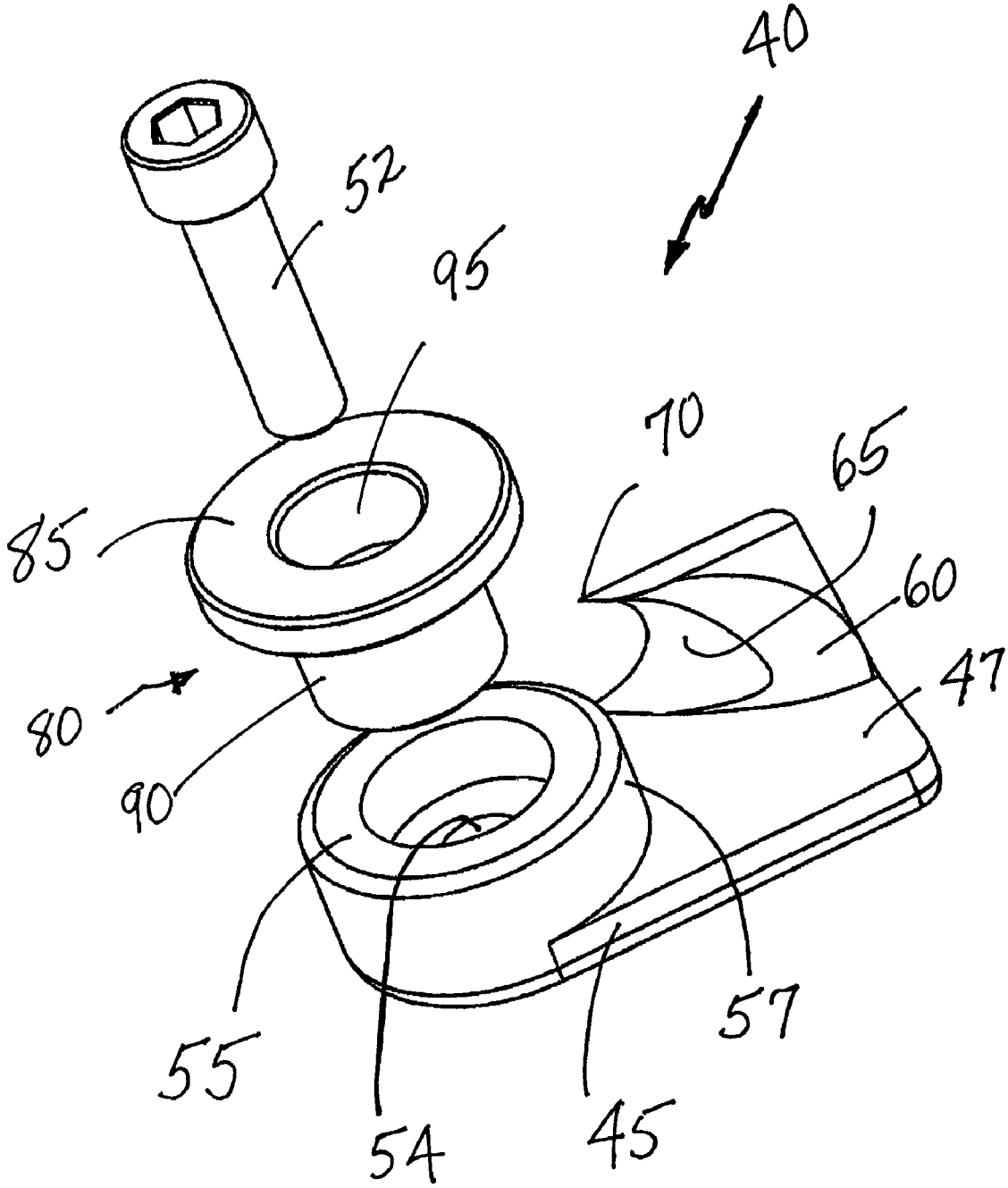
FIG. 7 is an exploded view of a further embodiment of the decrimping head member of the auto body decrimping tool assembly of the present invention.

The decrimping head member 40, illustrated in detail in FIGS. 5-7, includes a base portion 45, having a first side 47 and a second side 48. The base portion's first side 47 is opposite the housing body member 20 and has a protruding contact section 50 and an opposed, protruding blade section 60, having a concave, helical surface 65 facing the contact section 50. Preferably, the contact section 50 is generally cylindrical in shape, with a cylindrical axis perpendicular to the base portion's first side 47 and with a cylindrical base member 57 facing the blade section 60. The blade section 60 includes a tapered edge 70 at a side of the concave, helical surface 65 opposite the base portion 45. The contact section's cylindrical base member 57 includes a shoulder area 55 with a planar surface that is approximately at the same level as the tapered edge 70 of the blade section 60. The cylindrical base member 57 also includes an aperture 54 that accepts an insert member 80, as illustrated in FIG. 7. The insert member 80 includes an enlarged head portion 85 atop a cylindrical body portion 90, with a central aperture 95 there through. The cylindrical body portion 90 fits into the aperture 54 in cylindrical base member 57, with the head portion 85 of the insert member 80 extending beyond the cylindrical base member's shoulder area 55 to produce a U-shaped groove in the contact section 50. A threaded fastener 52 positioned through both apertures 95 and 54 and through the decrimping head member's base portion 45, engages the drive shaft member 35 positioned in the second aperture 30 of the hollow body member 20. Thus, the decrimping head member 40 is removably mounted to the drive shaft member 35 at the contact section 50.

The second side 48 of the base portion 45 of the decrimping head member 40 includes a multipoint indentation 75 that surrounds the aperture 54 through the contact section 50, as illustrated in FIG. 6. The multipoint indentation 75 engages a nut-like end of the drive shaft member 35, as the threaded fastener 52 engages a threaded aperture in the drive shaft member 35, thereby allowing a number of orientations of the decrimping head member 40 relative to the hollow housing body member 20.

Referring again to FIGS. 1 and 2, a power source, such as a pneumatically powered motor 110 supplied with compressed air from a supply line attached at the air inlet 115, is positioned at the body member's first aperture 25. The motor 110 is operably connected to the drive shaft member 35 to impart reciprocal rotary motion to the drive shaft member 35, thereby causing the blade section 60 and tapered edge 70 of the decrimping head member 40 to pivot relative to the contact section 50. The pivoting movement of the decrimping head member 40 is through an arc of about 5 degrees.

In one embodiment of the invention, the drive shaft member 35 includes a yoke member secured to the drive shaft member 35 and positioned within the hollow housing member 20. The power source 110 includes a shaft with an eccentric member attached thereto, with the eccentric member positioned within the yoke member, which is secured to the drive shaft member 35. Rotation of the eccentric member within the yoke member produces reciprocating rotary motion of the drive shaft member 35, causing the blade section 60 and tapered edge 70 of the decrimping head member 40 to pivot relative to the contact section 50.

Figure 8:
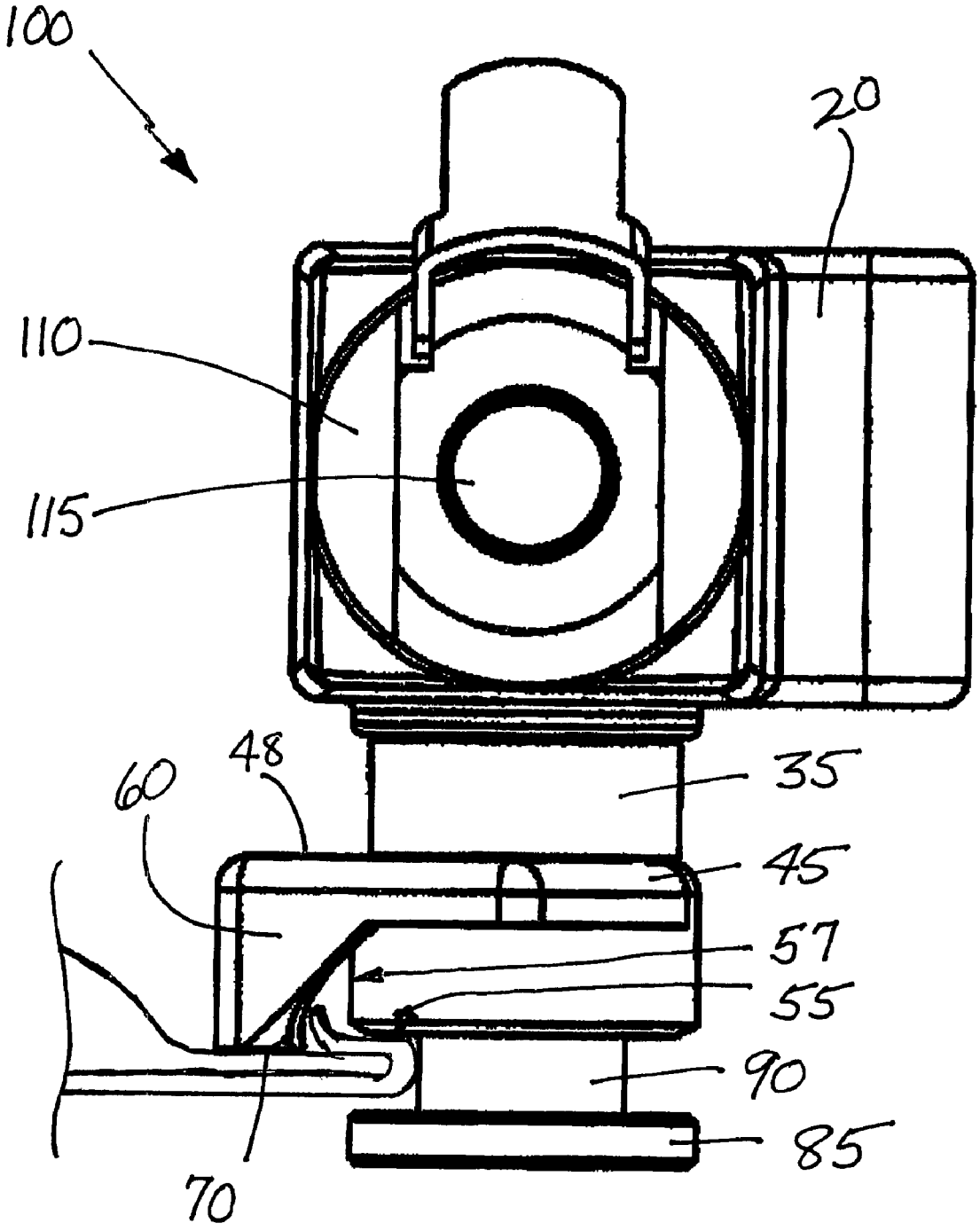
FIG. 8 is a perspective end view of the auto body decrimping tool assembly of the present invention during the decrimping of a panel from the frame of a vehicle.

In use, the decrimping head member 40 is positioned at an edge of a crimped panel, with the panel edge resting on the contact section's planar shoulder area 55 and with the tapered edge 70 of the blade section 60 between the crimped panel and the frame, as illustrated in FIG. 8. The power source 110 positioned at the body member's first aperture 25 and operably connected to the drive shaft member 35, imparts reciprocal rotary motion to the drive shaft member 35. The drive shaft member 35 causes the blade section 60 and tapered edge 70 of the decrimping head member 40 to reciprocally pivot relative to the contact section 50, thereby incrementally decrimping the crimped panel from the frame as the edges of the crimped panel and frame move between the blade section 60 and the contact section 50 of the decrimping head member 40. The decrimping head member 40 functions to decrimp a door skin panel from a door frame by rolling the crimped edge open to about 135 degrees relative to the door frame. Consequently, the damaged door skin panel is easily removed from the door frame.

Alternatively, the decrimping head member 40 can function not only to decrimp a panel from a frame, as outlined above, but also sever the decrimped flange from the panel. Consequently, the damaged panel is more easily removed from the frame. The severing of the decrimped flange requires an extremely sharp, tapered edge 70 for the blade section 60 of the decrimping head member 40.

While the invention has been particularly shown and described with reference to preferred embodiments thereof, it will be understood by those skilled in the art that various changes in form and details may be made therein without departing from the spirit and scope of the invention.

What is claimed is:

1. An auto body decrimping tool assembly adapted for decrimping a panel from a frame, the decrimping tool assembly comprising:

(a) a hollow housing body member with a first aperture centered on a body member's first axis at one end thereof, the body member containing a second aperture centered on a body member's second axis perpendicular to the first axis; and (b) a decrimping head member pivotally mounted near an end thereof on a drive shaft member rotatably secured in the body member's second aperture, the decrimping head member including a base member having first and second sides, the base member's first side opposite the housing body member and having a protruding contact section and an opposed, protruding blade section having a concave, helical surface facing the contact section, the blade section including a tapered edge at a side of the concave, helical surface opposite the base portion, the decrimping head member mounted to the drive shaft member at the contact section, the contact section of the decrimping head member including a U-shaped groove formed by a cylindrical base member of the contact section having a shoulder area aligned with the tapered edge of the blade section, and an insert member fastened atop the cylindrical base member, the insert member including a cylindrical body portion, smaller than the cylindrical base member, with an enlarged head portion opposite the cylindrical base member, thereby forming the U-shaped groove of the contact section;

whereby positioning the decrimping head member at an edge of the panel crimped to the frame with the contact section on an edge of the crimped panel and the tapered edge of the blade section between the crimped panel and the frame; and whereby a power source positioned at the body member's first aperture, and operably connected to the drive shaft member, imparts reciprocal rotary motion to the drive shaft member, causing the blade section and the tapered edge of the decrimping head member to reciprocally pivot relative to the contact section, thereby incrementally decrimping the crimped panel from the frame as the crimped panel and frame move between the blade section and the contact section of the decrimping head member.

2. The auto body decrimping tool assembly adapted for decrimping a panel from a frame of claim 1, wherein the insert member is fastened to the cylindrical base member and to the drive shaft member by a threaded fastener positioned there through.

3. The auto body decrimping tool assembly adapted for decrimping a panel from a frame of claim 1, wherein the second side of the base portion of the decrimping head member includes a multipoint indentation surrounding an aperture that accepts the drive shaft member, the multipoint indentation engaging a nut-like end of the drive shaft member, thereby allowing selected orientation of the decrimping head member relative to the hollow housing body member.

4. An auto body decrimping tool assembly adapted for decrimping a panel from a frame, the decrimping tool assembly comprising:

(a) a hollow housing body member with a first aperture centered on a body member's first axis at one end thereof, the body member containing a second aperture centered on a body member's second axis perpendicular to the first axis;

(b) a decrimping head member pivotally mounted near an end thereof on a drive shaft member rotatably secured in the body member's second aperture, the decrimping head member including a base member having first and second sides, the base member's first side opposite the housing body member and having a protruding contact section and an opposed, protruding blade section having a concave, helical surface facing the contact section, the blade section including a tapered edge at a side of the concave, helical surface opposite the base portion, the decrimping head member mounted to the drive shaft member at the contact section, the contact section of the decrimping head member including a U-shaped groove formed by a cylindrical base member of the contact section having a shoulder area aligned with the tapered edge of the blade section, and an insert member fastened atop the cylindrical base member the insert member including a cylindrical body portion, smaller than the cylindrical base member, with an enlarged head portion opposite the cylindrical base member, thereby forming the U-shaped groove of the contact section; and (c) a power source positioned and secured at the body member's first aperture, the power source operably connected to the drive shaft member and imparting reciprocal rotary motion to the drive shaft, causing the blade section and the tapered edge of the decrimping head member to reciprocally pivot relative to the contact section;

whereby positioning the decrimping head member at an edge of the panel crimped to the frame with the contact section on an edge of the crimped panel and the tapered edge of the blade section between the crimped panel and the frame, and operating the power source to reciprocally pivot the blade section and the tapered edge relative to the contact section;

thereby incrementally decrimping the crimped panel from the frame as the crimped panel and frame move between the blade section and the contact section of the decrimping head member.

5. The auto body decrimping tool assembly adapted for decrimping a panel from a frame of claim 4, wherein the insert member is fastened to the cylindrical base member and to the drive shaft member by a threaded fastener positioned there through.

6. The auto body decrimping tool assembly adapted for decrimping a panel from a frame of claim 4, wherein the second side of the base portion of the decrimping head member includes a multipoint indentation surrounding an aperture that accepts the drive shaft member, the multipoint indentation engaging a nut-like end of the drive shaft member, thereby allowing selected orientation of the decrimping head member relative to the hollow housing body member.

7. The auto body decrimping tool assembly adapted for decrimping a panel from a frame of claim 4, wherein the power source is a pneumatically powered motor.

8. An auto body decrimping tool assembly adapted for decrimping a panel from a frame, the decrimping tool assembly comprising:

(a) a hollow housing body member with a first aperture centered on a body member's first axis at one end thereof, the body member containing a second aperture centered on a body member's second axis perpendicular to the first axis;

(b) a decrimping head member pivotally mounted near an end thereof on a drive shaft member rotatably secured in the body member's second aperture, the decrimping head member including a base member having first and second sides, the base member's first side opposite the housing body member and having a protruding contact section and an opposed, protruding blade section having a concave, helical surface facing the contact section, the blade section including a tapered edge at a side of the concave, helical surface opposite the base portion, the decrimping head member mounted to the drive shaft member at the contact section, the contact section of the decrimping head member including a U-shaped groove formed by a cylindrical base member of the contact section having a shoulder area aligned with the tapered edge of the blade section, and an insert member fastened atop the cylindrical base member, the insert member including a cylindrical body portion, smaller than the cylindrical base member, with an enlarged head portion opposite the cylindrical base member, thereby forming the U-shaped groove of the contact section; and (c) a pneumatically powered motor positioned and secured at the body member's first aperture, the pneumatically powered motor operably connected to the drive shaft member and imparting reciprocal rotary motion to the drive shaft, causing the blade section and the tapered edge of the decrimping head member to reciprocally pivot relative to the contact section;

whereby positioning the decrimping head member at an edge of the panel crimped to the frame with the contact section on an edge of the crimped panel and the tapered edge of the blade section between the crimped panel and the frame, and operating the pneumatically powered motor to reciprocally pivot the blade section and the tapered edge relative to the contact section;

thereby incrementally decrimping the crimped panel from the frame as the crimped panel and frame move between the blade section and the contact section of the decrimping head member.

9. The auto body decrimping tool assembly adapted for decrimping a panel from a frame of claim 8, wherein the insert member is fastened to the cylindrical base member and to the drive shaft member by a threaded fastener positioned there through.

10. The auto body decrimping tool assembly adapted for decrimping a panel from a frame of claim 8, wherein the second side of the base portion of the decrimping head member includes a multipoint indentation surrounding an aperture that accepts the drive shaft member, the multipoint indentation engaging a nut-like end of the drive shaft member, thereby allowing selected orientation of the decrimping head member relative to the hollow housing body member.

* * * * *